US006554626B2

(12) United States Patent
Ramos, Jr.

(10) Patent No.: US 6,554,626 B2
(45) Date of Patent: Apr. 29, 2003

(54) ELECTRICAL RECEPTACLE ASSEMBLY

(75) Inventor: Phillip M. Ramos, Jr., Anaheim, CA (US)

(73) Assignee: Philatron International, Santa Fe Springs, CA (US)

( * ) Notice: Subject to any disclaimer, the term of this patent is extended or adjusted under 35 U.S.C. 154(b) by 0 days.

(21) Appl. No.: 10/123,976

(22) Filed: Apr. 16, 2002

(65) Prior Publication Data

US 2002/0151225 A1 Oct. 17, 2002

Related U.S. Application Data

(60) Provisional application No. 60/284,727, filed on Apr. 17, 2001.

(51) Int. Cl.[7] ..... H01R 13/44

(52) U.S. Cl. ..... 439/144; 439/318; 439/372; 439/533

(58) Field of Search ..... 439/144, 903, 439/35, 332, 333, 335, 372, 533, 318, 319

(56) References Cited

U.S. PATENT DOCUMENTS 4,312,553 A * 1/1982 Lyckesjo ..... 439/144
4,718,865 A * 1/1988 Cordeiro ..... 439/606
4,786,261 A 11/1988 Ramos, Jr.
5,385,476 A * 1/1995 Jasper ..... 336/90
5,873,744 A 2/1999 Ramos, Jr.
5,885,098 A * 3/1999 Witkowski ..... 439/136
6,273,756 B1 * 8/2001 Ward et al. ..... 439/372
6,364,681 B1 * 4/2002 Watanabe ..... 439/335

* cited by examiner

*Primary Examiner*—Lynn D. Field
*Assistant Examiner*—Phuong K Dinh
(74) *Attorney, Agent, or Firm*—John E. Wagner; Robert C. Smith

(57) ABSTRACT

An electrical connector for use with a tractor-trailer includes a receptacle having a generally cylindrical outer body and a molded inner body encapsulating a plurality of conductors secured to connector pins. To provide additional current carrying capacity to accommodate an automatic braking system (ABS) one of the conductors designated as a ground conductor is larger than all of the other conductors. A conductor carrying ABS current is larger than all conductors except the ground conductor. The inner and outer bodies are fastened together by means of a bayonet connection. An additional securing device includes a projection on the inner body which is held in position by means of a bail attached to the outer body. To reduce resistance at the contacts, all contacts are soldered or crimped to their respective conductors and molded within the inner body to protect all wires and connections to the connector pins from environmentally caused corrosion or damage. The outer body includes outward extending flanges for mounting and protection from damage upon operating the bayonet connection. The receptacle provides a protective door for contact connectors when not in use and a latch on the door to engage and lock an external plug when inserted properly.

9 Claims, 6 Drawing Sheets

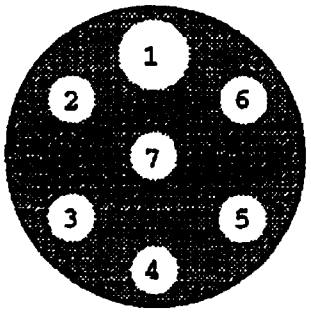

1 - WHITE
2 - BLACK
3 - YELLOW
4 - RED
5 - GREEN
6 - BROWN
7 - BLUE

FIG. 1

| Contact No. | Color Code | Circuit Purpose: To supply electrical power from tractor to trailer for the following: | Industry's Max. Wire Size | TNT-11 Max. Wire Size |
|---|---|---|---|---|
| 1 | White | Ground | 8 AWG | **6 AWG** |
| 2 | Black | Clearance, side maker, & identification lamps. | 12 AWG | 12 AWG |
| 3 | Yellow | Left turn signal & hazard signal lamps. | 12 AWG | 12 AWG |
| 4 | Red | Stop lamps & anti-lock devices. | 10 AWG | 10·AWG |
| 5 | Green | Right turn signal & hazard signal lamps. | 12 AWG | 12 AWG |
| 6 | Brown | Tail & license plate lamps. | 12 AWG | 12 AWG |
| 7 | Blue | Auxiliary circuits & continuous ABS power. | 10 AWG | **8 AWG** |

FIG. 2a
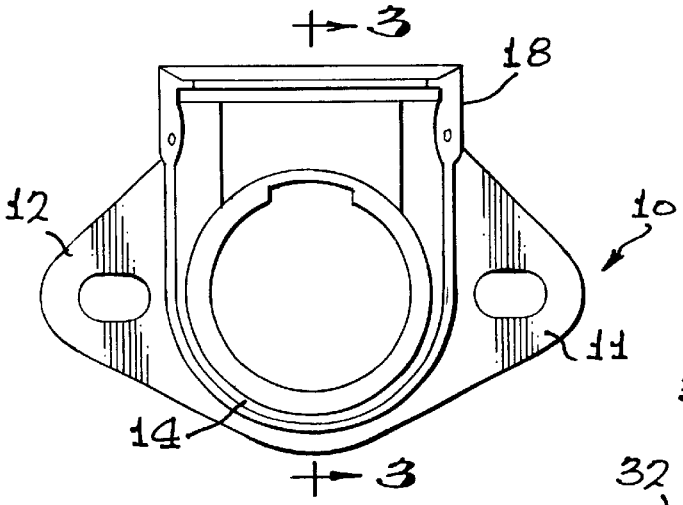
FIG. 5
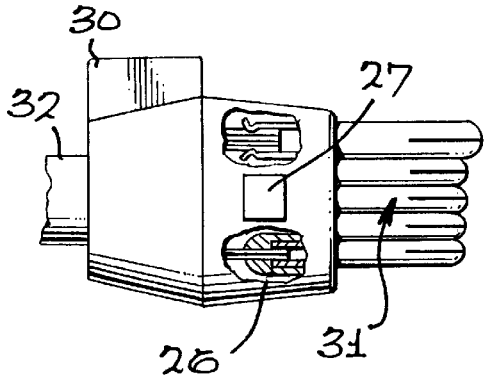
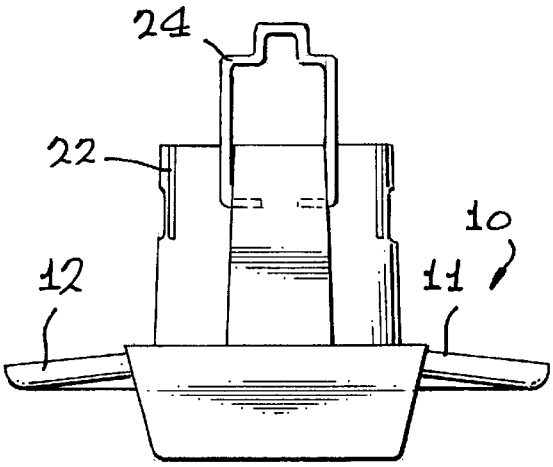
FIG. 2b
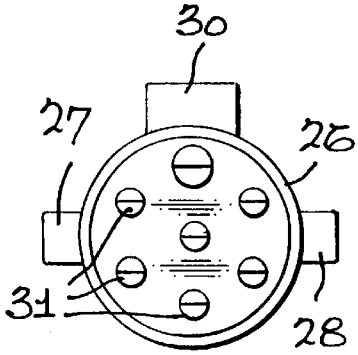
FIG. 4
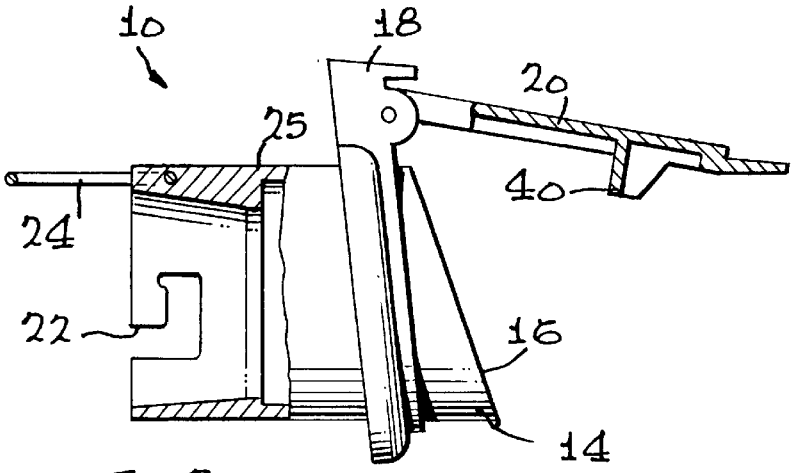
FIG. 3

FIG. 6
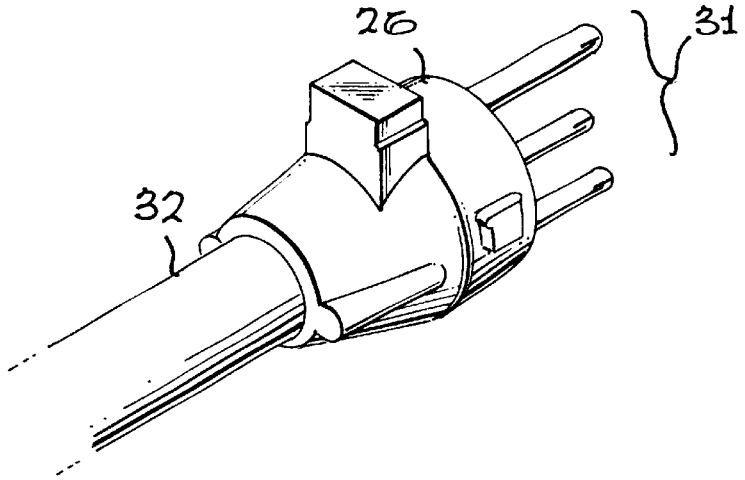
FIG. 7
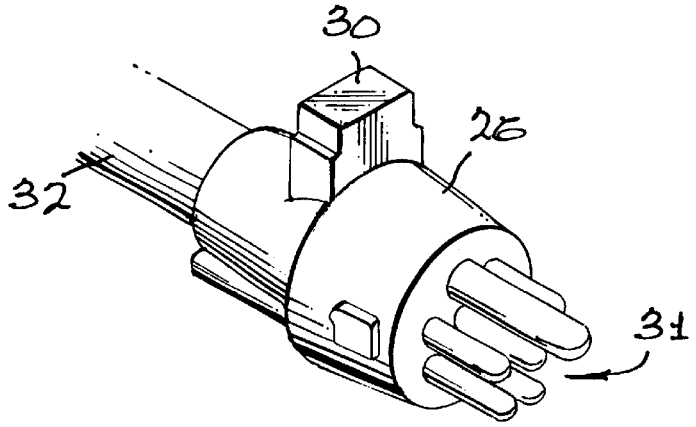
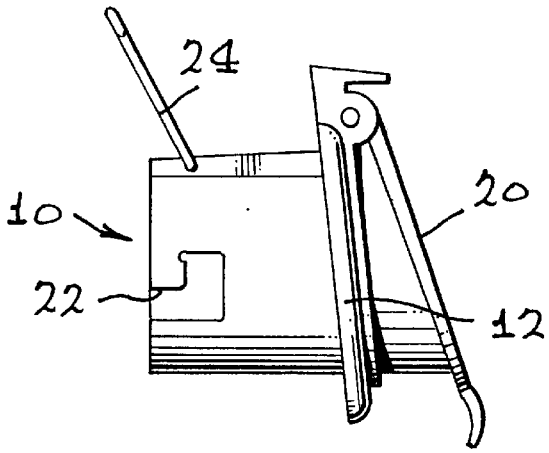
FIG. 10
FIG. 11
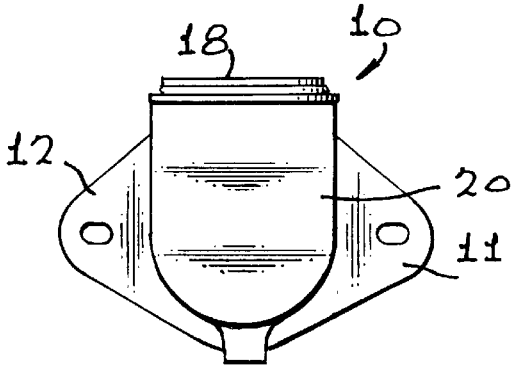

ELECTRICAL RECEPTACLE ASSEMBLY

REFERENCE TO RELATED APPLICATION

This non-provisional patent application claims benefit of U.S. provisional patent application Ser. No. 60/284,727 filed Apr. 17, 2001, and hereby claims the benefit of the embodiments therein and of the filing date thereof.

BACKGROUND OF THE INVENTION

Certain seven conductor electrical connectors for truck-trailer jumper cables have become standard in the industry. A connector which is typical of those in commercial use is shown in my U.S. Pat. No. 5,873,744. Details of a prior art connector assembly for tractor-trailers are disclosed in my U.S. Pat. No. 4,786,261. The connectors are subject to SAE standard J560 b. This standard covers two connectors, the plug and the receptacle. The plugs are normally attached at both ends to a jumper cable. The connectors or receptacles are installed as permanent parts of the truck and trailer. Each connector has seven terminal contacts. Common practice for attaching the receptacle's terminal contacts to the wire conductors is accomplished by either:

1) attachment by inserting copper conductor into a hole centered at back end of the terminal contact and securing in place by tightening a screw tapped at a right angle to the hole; or
2) by crimping a bullet-type female disconnect terminal to the copper conductor and connecting it to the receptacle contact back end, which was machined into the form of a male bullet terminal.

The above-described connectors were generally satisfactory until the Department of Transportation (DOT) of the United States Government mandated that all new trucks exceeding 10,000 pounds must have anti-lock braking systems (ABS). The addition of ABS required that certain conductors carry more power, and preferably a larger size seven-conductor cable. However, the original SAE (Society of Automotive Engineers) seven-way receptacles were not designed to accommodate the larger size cable. The industry argued with the DOT that to change the large numbers of existing vehicles to a new receptacle design would be extremely costly. The DOT then agreed to permit a smaller size cable for activating the ABS.

Because of the undersized cable, overheating of the contacts soon became a problem, which was exacerbated, and this was increased with the introduction of new road solvents to break up ice. The overheated contacts and the new solvents rapidly induced corrosion. In some incidents, the heat at the corroded contacts became so intense that fires broke out.

Thus, it appears that there is a need for a connector or receptacle which will fit existing plugs and which is interchangeable with any standard SAE J560 b receptacle, but which is not subject to the excessive heating and corrosion described above.

BRIEF SUMMARY OF THE INVENTION

The applicant has dealt with the above problems by redesigning the receptacle without increasing its size and without increasing the size of its contacts. This has involved two primary changes in the receptacle.

First, the resistance at the contacts has been substantially reduced by better attachment of the contacts to the conductors. Rather than using the screw-type or bullet-type connections, the contacts are crimped or soldered to the conductors.

Second, the receptacle itself is redesigned to be interchangeable with the standard J560 b plug, but two of the conductors have been increased in size to handle the increased automatic braking system (ABS) current load. The ground conductor was increased from a maximum 8 American Wire Gauge (AWG) to a 6 AWG; and where deemed necessary, the ABS designated conductor was increased from a 10 AWG to an 8 AWG. All the contacts and conductors are injection molded into a high temperature thermoplastic inner body, which protects the contact/conductor terminations from moisture and solvents. It will be recognized that thermoplastic covers a large range of materials, including PVC, TPE, polycarbonate, ABS, etc.

Additional features of this invention were also achieved during its development and are described in detail below but may be summarized.

BRIEF DESCRIPTION OF THE DRAWINGS

This invention may be more clearly understood with the following description and by reference to the drawings in which:

FIG. 1 is a wiring color code for the receptacle of the invention;

FIG. 2*a* is a front elevational view of the outer body of the receptacle of the invention;

FIG. 2*b* is a top plan view of the receptacle of FIG. 2*a;*

FIG. 3 is a sectional view taken along line 3—3 of FIG. 2*a;*

FIG. 4 is a front view of the receptacle inner body;

FIG. 5 is a side elevational view of the receptacle inner body partly broken away and showing the terminal pins, and one soldered and one crimped connection for illustration;

FIG. 6 is a rear perspective view of the receptacle inner body and cable;

FIG. 7 is a front perspective view of the receptacle inner body and cable;

FIG. 10 is a side view of the outer body of the receptacle of FIG. 8;

FIG. 11 is a front elevation view of the receptacle of FIG. 8;

DETAILED DESCRIPTION

Figure 8:
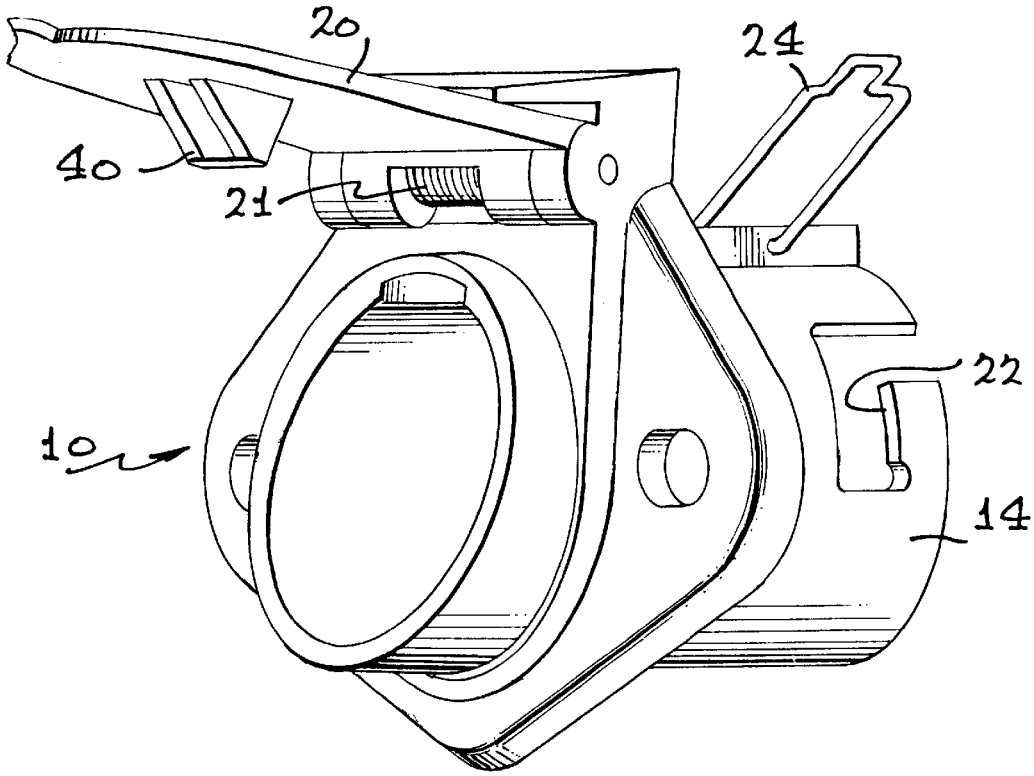
FIG. 8 is a front perspective view of the outer body of the receptacle of the invention.

Initially, FIG. 1 refers to a diagram and a table identifying the conductors used in the receptacle of the invention and assigning a wiring color code to the wires connecting the respective contacts. Also included in the table is a comparison of the industry's maximum wire size as compared with the maximum wire size in this invention designated as TNT-11.

FIG. 2*a* shows a front elevational view of the outer body 10 of the receptacle. Outer body 10 includes mounting flange extensions 11 and 12 and a cylindrical section 14 which is tapered at its outer end 16, as shown on FIG. 3. Supported on an upstanding boss 18 is a spring-loaded cover 20, which covers the receptacle when no plug is attached. At the opposite end of cylindrical section 14 is an "L" shaped notch 22 constituting part of a bayonet connector for attaching the receptacle inner body. A similar notch is on the opposite side of cylindrical section 14. A bail 24 carried on a ridge 25 on the top of cylindrical section 14 provides an additional means of securing the receptacle inner body 26, first shown in FIG. 5, to outer body 10.

For a top view of the outer body 10 of the receptacle of this invention, see FIG. 2*b* showing the extent of the flanges 11 and 12, the second bayonet slot 22, and particularly the bail 24, with its prongs resting in holes in the outer body 10 at its boss 30, which clearly appears in FIG. 5.

FIG. 3 is a side elevational view of the outer body 10, with a portion broken away at the rear to form notch 22 as indicated by the section arrow above FIG. 2*b*. This figure illustrates that the inner cavity of body 10 is tapered and matches the front taper of the inner body 26 of FIG. 5. Thus, the two body parts 10 and 26 have not only a bayonet lock, but a taper lock and a bail lock to insure integrity of the receptacle.

FIG. 4 is an end view of the body 26 of FIG. 4 showing the side projections 26 and 27 and a boss 30.

FIG. 5 is a side elevational view of the plug which forms the inner body 26, which is a molded member that carries bosses or projections 27 and 28 constituting mating parts of the bayonet connection, when seated in notch 22 of inner body 10. An additional upstanding boss 30 on plug 26 mates with bail 24 to secure the plug in the rear of the receptacle 26. The several pin-type connectors 31 and their connections to their separate conductors are molded into inner body 26.

Parts of the plug 26 are broken away to illustrate the electrical connection from the wires of cable 32 to their respective terminal pins 31. The connection to the larger pin 31 is shown as crimped, and the connection to the lowermost and smaller terminal pin 31 is by soldering. Of course, in actual manufacturing procedures, the same type of connection would be used.

Now referring to FIGS. 6 and 7, perspective views of inner body 26, which is molded around the end of a cable 32. As indicated above in the Brief Summary of the Invention, the applicant was able to employ larger conductors within the same size receptacle body for greater current carrying capacity and utilize more reliable crimped or soldered connections to conductors in cable 32. The entire plug 26 is a molded body so that all connections between the cable 26 and the pins 31 are sealed. Reliability and increase in current carrying ability and immunity to road and rain contamination is enhanced.

Further details of the construction of outer body 10 are shown in the perspective view, FIG. 8. This view shows the cylindrical section 14 with the notch 22, bail 24 and cover 20.

FIG. 8 particularly shows the door 20 in an opened position against its return spring 21 and the latch to secure an outer cable connector when engaged. This is a feature of my previous U.S. Pat. No. 5,873,744, a copy of which is attached hereto and is incorporated by reference. It should be noted that my earlier U.S. Pat. No. 5,873,744 illustrates also the prior art approach for connections between the receptacle's cable 32, namely, exposed screw terminals. That arrangement is eliminated by employing this current invention.

Figure 9:
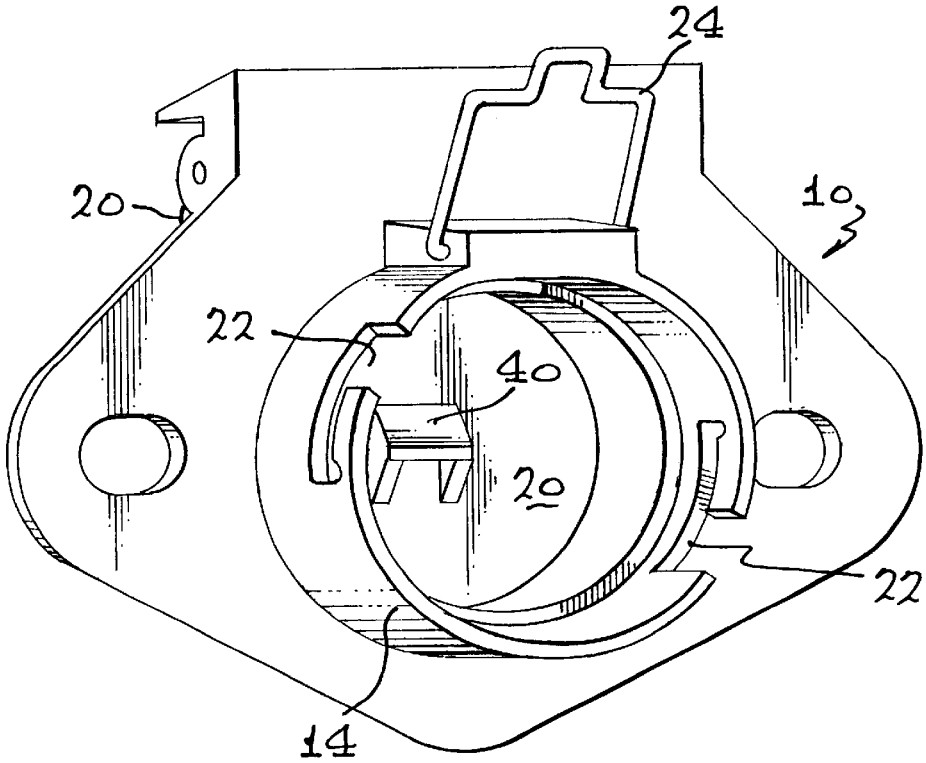
FIG. 9 is a rear perspective view of the receptacle of FIG. 8 with the cover closed.

FIG. 9 shows the rear side of outer body 10, including bail 24, cylindrical section 14 and the cover 20 closed. Cover 20 is biased in the closing direction by a spring 21 (FIG. 8). The bail 24 engages a boss 30 on the body 26 as illustrated particularly in FIGS. 6 and 7.

FIG. 10 is a side elevation showing cylindrical section 14 with cover 20 closed effectively sealing the pins 31 from contamination.

FIG. 11 is an outer end view showing cover 20 closed and sealed.

Figure 12:
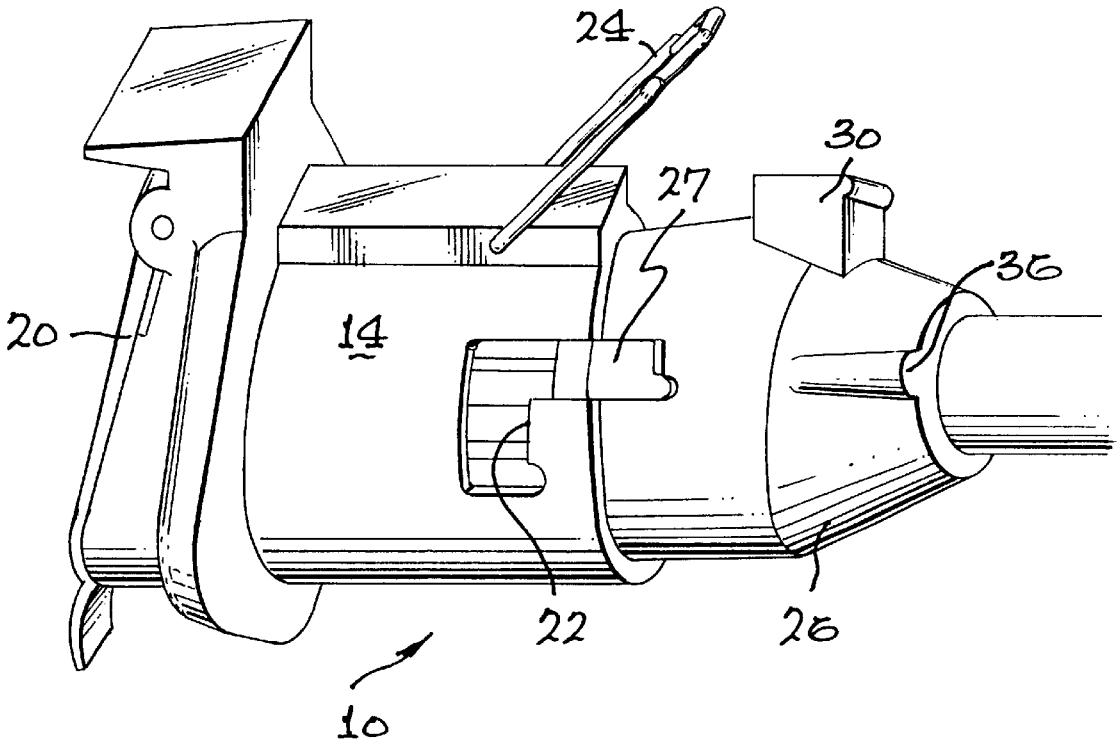
FIG. 12 is a rear perspective view of the receptacle inner body and cable being plugged into the receptacle outer body.

FIG. 12 is a rear perspective view of the inner body 26 in the process of being connected to outer body 10. Boss 27 is just entering notch 22, and bail 24 is not yet secured over boss 30 since the inner body or plug 26 has yet to be turned by about 30 degrees downward after full insertion into L-shaped slot 22. Then the bail 24 may be engaged with boss 30 and the receptacle 10 is fully operational. Inner body 26 also includes some radially extending flanges 36 to aid in turning inner body 26 into or out of outer body 10.

Figure 13:
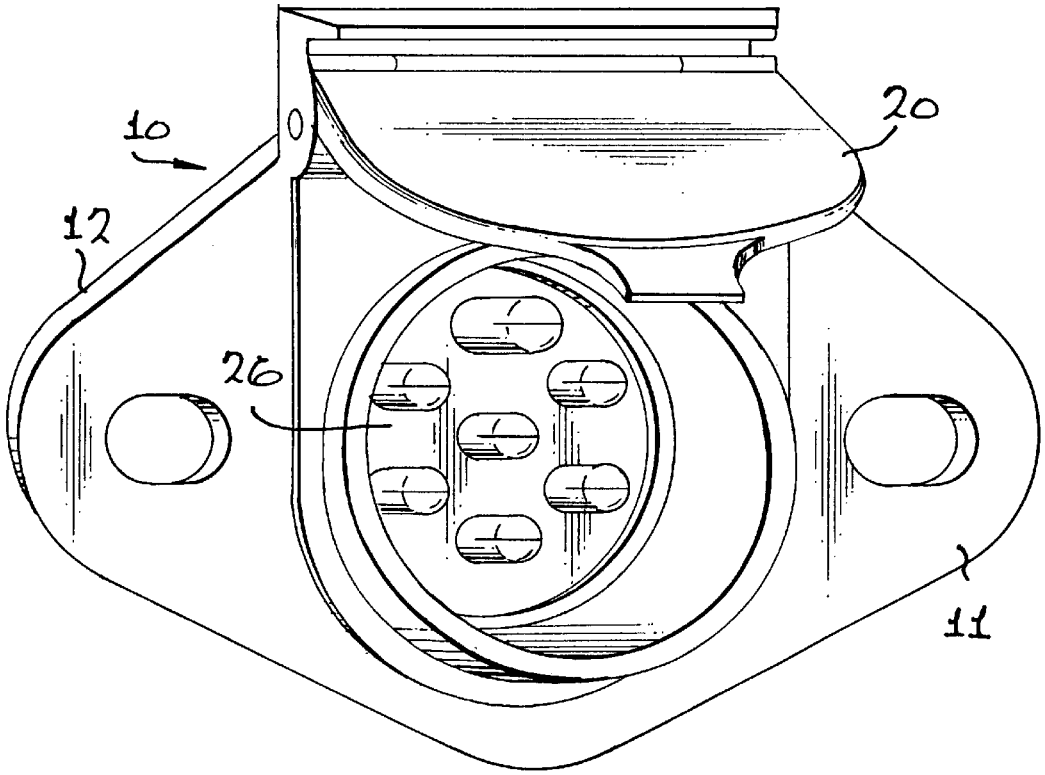
FIG. 13 is a front perspective view of the receptacle inner body secured in the outer body.

FIG. 13 is a front perspective view showing the inner body 26 positioned within outer body 10 and with the cover 20 shown open. It should be noted that the flanges 11 and 12 are broad and allow for attachment to the bulkhead of a vehicle at two widely spaced and slightly adjustable positions. Machine screws with appropriate lock nuts will assure integrity in the face of many connections and disconnections of an external cable and also, the inner body 26, and its cable 32, which involves the twisting and locking operation described above.

Figure 14:
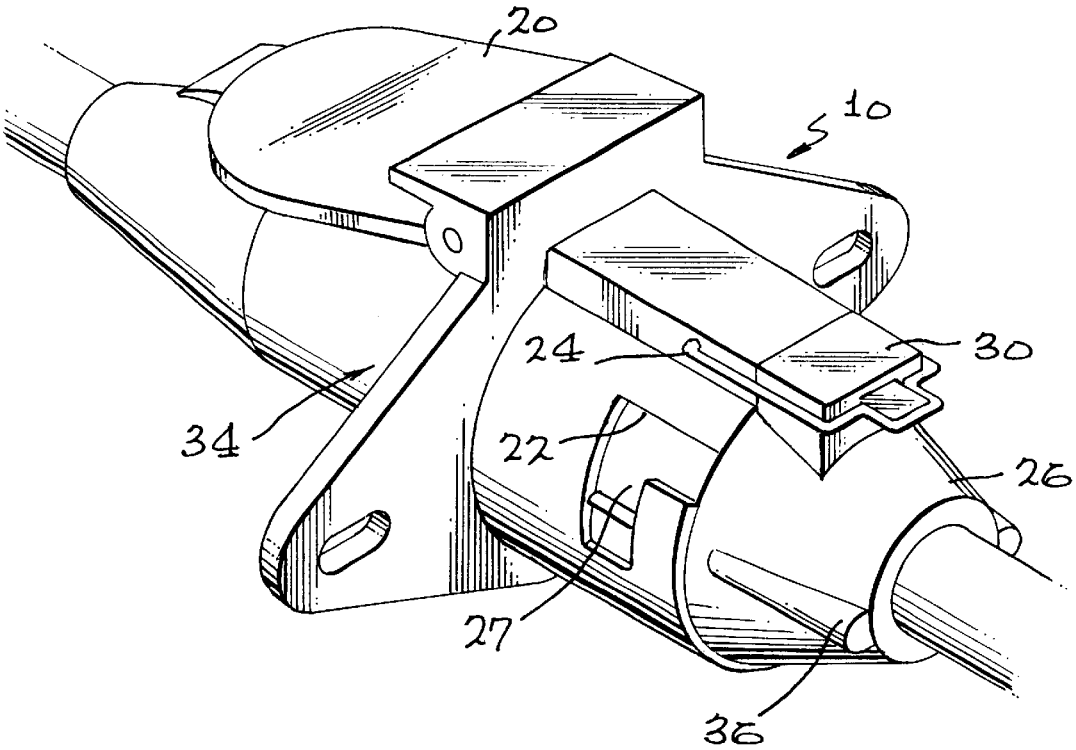
FIG. 14 is perspective view of the receptacle inner body secured in the outer body and with a plug secured to the receptacle.

FIG. 14 is a rear perspective view of the inner body 26 completely secured in outer body 10 with boss 27 secured in notch 22, bail 24 fastened over boss 30 and an external plug 34 plugged into the receptacle and plug secured in place by cover 20. Cover 20 is held open by plug 34, and locked in place by the stop 40 (FIG. 15) on the underside of door 20.

Figure 15:
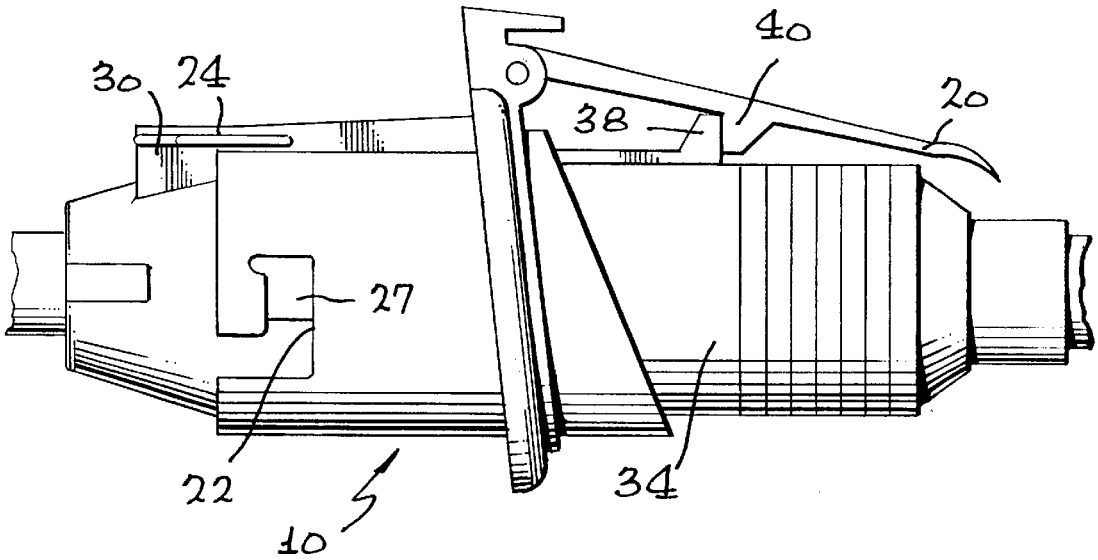
FIG. 15 is a side view of the receptacle inner body secured in the outer body and a plug inserted into the receptacle.

FIG. 15 is a side elevational view similar to FIG. 14 showing plug 34 plugged into the receptacle. Plug 34 has an upstanding projection 38, which is engaged by a downwardly projecting protuberance or stop 40 of cover 20 to secure plug 34 in the receptacle. This is the normal operational condition.

SUMMARY

Altogether, the receptacle assembly of this invention provides:

a) fully enclosed and sealed terminals with only the contact pins 31 exposed. The pins are covered by the cover 20 whenever the receptacle is not in use and covered by the receptacle body and the external plug;

b) permanent connections of the conductor wires, such as by crimping or soldering at the factory and not subject to environmental caused corrosion;

c) the receptacle is made up of an outer and an inner body engaged by a bayonet lock and secured by a bail engaging a boss on the inner body;

d) any external cable plug 34 shielded by the outer body of the receptacle and locked in place by the cover 20, as taught in my U.S. Pat. No. 5,873,744;

e) thus both the inner body and the external plug are both locked to the receptacle outer body in place;

f) the receptacle is protected from damage due to torsional stress upon insertion and locking of the inner body within the outer body by the integral wide flanges 11 and 12.

The above-described embodiments of the present invention are merely descriptive of its principles and are not to be considered limiting. The scope of the present invention instead shall be determined from the scope of the following claims including their equivalents.

I claim:

1. An electrical connector assembly for use with tractor-trailers comprising a receptacle having an inner body and an outer body;

said outer body having a recess to receive a cylindrical plug, a bayonet-type slot in said recess, a ridge on the surface of said outer body, and a bail secured to said ridge;

said inner body including a generally cylindrical molded plug at least partially contained within said outer body, a plurality of conductors and a plurality of pin-type connectors secured to said conductors, said conductors and said pin-type connectors being molded into said plug;

said inner body having at least two external bosses;

said inner body being secured to said outer body by a twist-type connection including one of said bosses in a bayonet-type connection and the second of said bosses being locked to said outer body in alignment with said ridge by said bail.

2. An electrical connector assembly as claimed in claim 1 wherein said pin-type connectors are soldered to said conductors.

3. For use with tractor-trailers, an electrical connector assembly wherein a receptacle is secured to a tractor, a similar receptacle is secured to a trailer, and a cable having a plurality of conductors and a plug at each end is adapted to be connected to said receptacle;

said receptacle comprising an inner body and a generally cylindrical outer body including a radially extending mounting flange, an upstanding pivot member adjacent said flange; a spring-loaded cover secured to said pivot member, a pair of slots defining part of a bayonet fastener formed in said outer body, a ridge on the surface of said outer body, and a bail pivotally secured to extend along said ridge;

said inner body including a molded plug carrying a pair of bosses which mate with said pair of slots to secure said bayonet fastener, and a third boss which is aligned with said ridge when said inner body is secured in said outer body and said bail is fastened over said third boss; and a plurality of conductors and a plurality of pin-type connectors secured to their respective conductors, said conductors and said pin-type connectors being molded into said inner body.

4. An electrical connector assembly as claimed in claim 3 wherein said pin-type connectors are crimped to said conductors.

5. An electrical connector assembly as claimed in claim 3 wherein said pin-type connectors are soldered to said conductors.

6. An electrical connector assembly as claimed in claim 3 wherein said inner body further includes a pair of radially extending flanges as an aid in turning said inner body within said outer body.

7. For use with tractor-trailers, an electrical connector assembly wherein a receptacle is secured to a tractor, a similar receptacle is secured to a trailer, a cable having a plurality of conductors and a plug at each end is adapted to be connected to said receptacles, said receptacles conforming with dimensions of a SAE standard J560b receptacle;

said receptacle including an inner body and a generally cylindrical outer body including a radially extending mounting flange;

said outer body further including a pair of slots defining part of a bayonet fastener, a ridge on the surface of said outer body, and a bail secured to said ridge;

said inner body including a molded plug carrying a pair of bosses which mate with said pair of slots to secure said bayonet fastener, and a third boss which is aligned with said ridge when said inner body is secured in said outer body, and said bail is fastened over said third boss; and a plurality of conductors and a plurality of pin-type connectors secured to their respective conductors, said pin-type connectors and ends of said conductors being molded into said inner body.

8. An electrical connector assembly as claimed in claim 7 wherein one of said conductors in said inner body is designated as a ground conductor and is significantly larger than the other conductors in said inner body, and another of said conductors in said inner body is designated to carry power for an automatic braking system and is larger than all other conductors in said inner body except for said ground conductor.

9. An electrical connector assembly as claimed in claim 7 wherein said outer body conforms with dimensions of a standard SAE J560b receptacle; and one of said conductors in said inner body is designated as ground conductor and can accommodate up to a size six (6) American Wire Gauge conductor and another of said conductors in said inner body is designated to carry power for an automatic braking system and can accommodate up to a size eight (8) American Wire Gauge conductor.

* * * * *